US011342710B2

(12) United States Patent
Hiramatsu et al.

(10) Patent No.: US 11,342,710 B2
(45) Date of Patent: May 24, 2022

(54) CONNECTOR

(71) Applicant: SUMITOMO WIRING SYSTEMS, LTD., Mie (JP)

(72) Inventors: Kazuki Hiramatsu, Mie (JP); Masakazu Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/088,795

(22) Filed: Nov. 4, 2020

(65) Prior Publication Data

US 2021/0151936 A1 May 20, 2021

(30) Foreign Application Priority Data

Nov. 15, 2019 (JP) ..... JP2019-207152

(51) Int. Cl.
*H01R 13/62* (2006.01)
*H01R 13/629* (2006.01)
*H01R 13/502* (2006.01)

(52) U.S. Cl.
CPC ... *H01R 13/62927* (2013.01); *H01R 13/5025* (2013.01); *H01R 13/62911* (2013.01)

(58) Field of Classification Search
CPC ..... H01R 13/62938; H01R 13/639; H01R 13/62933
USPC ..... 439/157, 347, 310
See application file for complete search history.

(56) References Cited

U.S. PATENT DOCUMENTS 5,902,141 A 5/1999 Iwahori
6,244,880 B1 * 6/2001 Fukase ..... H01R 13/62911 439/157
6,361,341 B1 3/2002 Okayasu et al.
9,865,966 B2 1/2018 Matsuura et al.

* cited by examiner

*Primary Examiner* — Phuong Chi Thi Nguyen
(74) *Attorney, Agent, or Firm* — Abelman, Frayne & Schwab

(57) ABSTRACT

A lever 50 is arranged movably from a partial locking position before connection of both housings 10, 90 and a full locking position after the connection with respect to the housing 10. Entrances 56 of cam grooves 54, 55 of the lever 50 are open in an edge part of the lever 50. The housing 10 includes a lock piece 31 resiliently displaceable in a direction intersecting a moving direction of the lever 50 to the full locking position. The lock piece 31 includes a lock portion 35 arranged at entrances 56 of the cam grooves 54, 55 and facing inner surfaces of the entrances 56 with the lever 50 located at the partial locking position. The lock portion 35 includes a protruding portion 37 projecting from the entrances 56 of the cam grooves 54, 55.

5 Claims, 10 Drawing Sheets

CONNECTOR

CROSS-REFERENCE TO RELATED APPLICATIONS

This application is based on and claims priority from Japanese Patent Application No. 2019-207152, filed on Nov. 15, 2019, with the Japan Patent Office, the disclosure of which is incorporated herein in their entireties by reference.

TECHNICAL FIELD

The present disclosure relates to a connector.

BACKGROUND

A connector disclosed in Japanese Patent Laid-Open Publication No. H09-266029 includes a female connector housing and a slider to be slidably mounted into the female connector housing. Deflectable flexible arms are provided on upper and lower walls of the female connector housing. A lock claw and a releasing projection are provided on the inner surface of the flexible arm. Cam grooves are provided in the inner surfaces of upper and lower slide plates of the slider. The upper and lower slide plates are laterally inserted into insertion holes of the female connector housing. The tips of the upper and lower slide plates contact the lock claws and the releasing projections are arranged at middle positions of the cam grooves, whereby the slider is held at a partial locking position with respect to the female connector housing. In that state, the female connector housing is connected to a male connector housing. At the time of connecting the both connector housings, engaging projections of the male connector housing are inserted into the entrances of the cam grooves. If the male connector housing is deeply inserted, the engaging projections reach the middle positions of the cam grooves to interfere with the releasing projections and the flexible arms are deflected and deformed. In this way, the lock claws are separated from locking positions and the slider can move to a full locking position. In the process of moving the slider from the partial locking position to the full locking position, the engaging projections slide on groove surfaces of the cam grooves and a connecting operation of the both connector housings proceeds. A technique for connector connection using a lever exemplified by such a slider is also disclosed in Japanese Patent Laid-Open Publication No. 2000-348817 and Japanese Patent Laid-Open Publication No. 2017-157503.

SUMMARY

In the above case, the engaging projections are inserted into the cam grooves and contact the releasing projections, whereby a partially locked state of the slider is released. The releasing projections need to be formed to have such size and shape as to be arranged at the middle positions of the cam grooves and accommodated in the cam grooves. Thus, it is difficult to ensure a degree of freedom in shape of the releasing projections, and the releasing projections become smaller in size. Further, since the flexible arms are provided with the lock claws separately from the releasing projections, there is a concern that the structure of the female connector housing becomes complicated.

Accordingly, the present disclosure aims to provide a connector having a high degree of freedom in shape for holding a lever in a partially locked state and capable of simplifying a structure.

The present disclosure is directed to a connector with a housing connectable to a mating housing, and a lever arranged movably from a partial locking position before connection of the both housings and a full locking position after the connection with respect to the housing, wherein the lever includes a cam groove, the mating housing includes a cam follower capable of contacting a groove surface of the cam groove, an entrance of the cam groove is open in an edge part of the lever, the housing includes a lock piece resiliently displaceable in a direction intersecting a moving direction of the lever to the full locking position, the lock piece includes a lock portion arranged at the entrance of the cam groove and facing an inner surface of the entrance of the cam groove with the lever located at the partial locking position, and the lock portion includes a protruding portion projecting from the entrance of the cam groove.

According to the present disclosure, it is possible to provide a connector having a high degree of freedom in shape for holding a lever in a partially locked state and capable of simplifying a structure.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
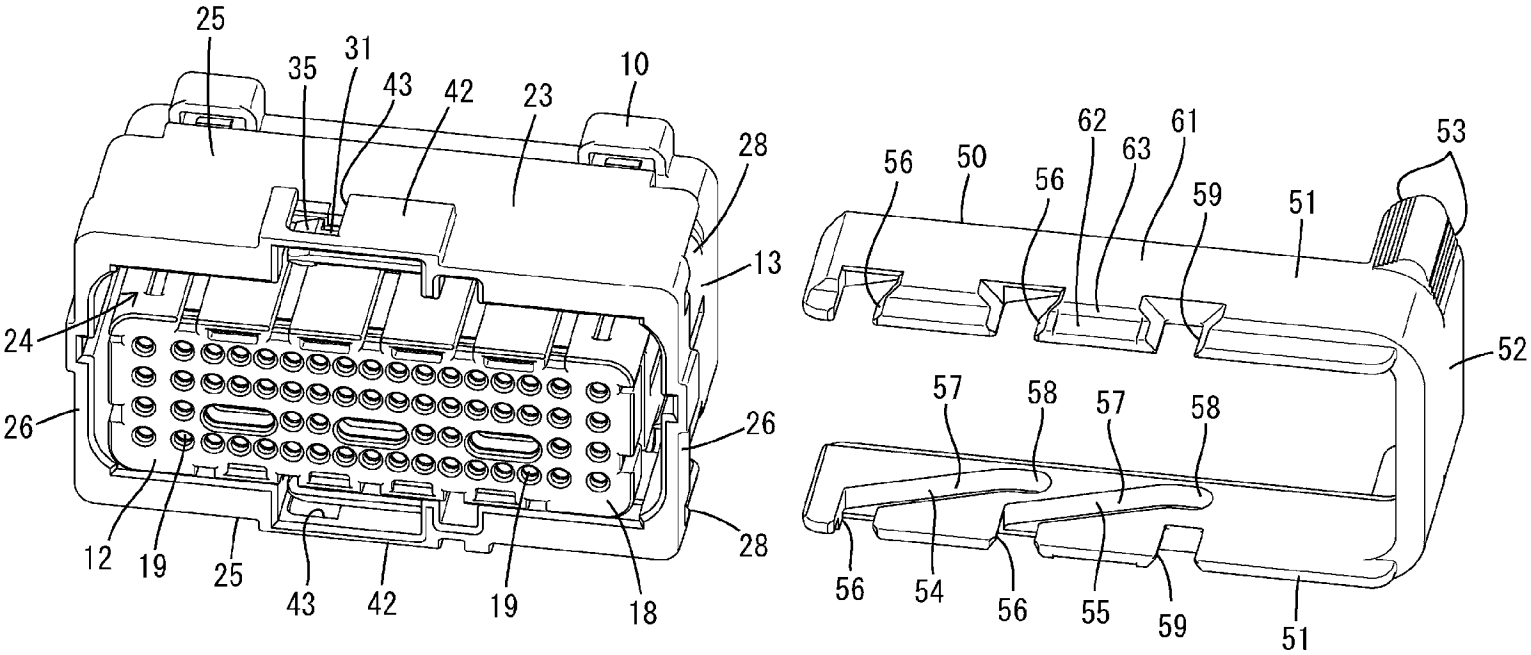
FIG. 1 is an exploded perspective view of a connector according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

First, embodiments of the present disclosure are listed and described.

(1) The connector of the present disclosure is provided with a housing connectable to a mating housing, and a lever arranged movably from a partial locking position before connection of the both housings and a full locking position after the connection with respect to the housing, wherein the lever includes a cam groove, the mating housing includes a cam follower capable of contacting a groove surface of the cam groove, an entrance of the cam groove is open in an edge part of the lever, the housing includes a lock piece resiliently displaceable in a direction intersecting a moving direction of the lever to the full locking position, the lock piece includes a lock portion arranged at the entrance of the cam groove and facing an inner surface of the entrance of the cam groove with the lever located at the partial locking position, and the lock portion includes a protruding portion projecting from the entrance of the cam groove. According to this configuration, since the lock portion can contact the inner surface of the entrance of the cam groove, the lever can be held at the partial locking position with movements restricted. When the both housings are connected, the cam follower of the mating housing can enter the entrance of the cam groove and interfere with the lock portion, and the lock piece can be resiliently displaced in the direction intersecting the moving direction of the lever to the full locking position. In this way, a partially locked state of the lever can be released. In the process of moving the lever to the full locking position, the cam follower slides on the groove surface of the cam groove and a connecting operation of the both housings proceeds.

In the above case, the lock portion includes the protruding portion projecting from the entrance of the cam groove. Thus, the size of the lock portion can be enlarged and a degree of freedom in shape can be enhanced. As a result, the lock portion can be made to stably contact the inner surface of the entrance of the cam groove and reliability in holding the lever at the partial locking position can be improved.

(2) Preferably, an insertion hole is provided to be open in one side surface of the housing, the cam groove includes a first cam groove arranged on a front side in the moving direction and a second cam groove arranged on a rear side in the moving direction, the cam follower includes a first cam follower corresponding to the first cam groove and a second cam follower corresponding to the second cam groove, the lock portion is arranged at an entrance of the first cam groove to face an inner surface of the entrance of the first cam groove with the lever arranged in the insertion hole and located at the partial locking position, and the lock portion is arranged at an entrance of the second cam groove to face an inner surface of the entrance of the second cam groove with the lever arranged in the insertion hole and located at the full locking position. According to this configuration, since the lock portion can contact the inner surface of the entrance of the second cam groove with the lever located at the full locking position, the lever can be held at the full locking position with movements restricted.

Since the first and second cam grooves have both a function of connecting the both housings and a function of restricting movements of the lever, the structure of the connector can be simplified as compared to the case where the both functions are separately provided.

(3) Another insertion hole may be provided to be open in another side surface opposite to the one side surface in the housing, the lever may include a recess side by side with the first and second cam grooves, the recess may be open in an edge part of the lever, and the lock portion may be arranged at the entrance of the second cam groove to face the inner surface of the entrance of the second cam groove when the lever is arranged in the other insertion hole and located at the partial locking position, and the lock portion may be arranged in the recess to face an inner surface of the recess when the lever is arranged in the other insertion hole and located at the full locking position. According to this configuration, the lever can be selectively arranged in either the insertion hole or the other insertion hole according to an installation situation of the connector or the like. Particularly, also when the lever is arranged in the other insertion hole and located at the full locking position, the lock portion can contact the inner surface of the recess and the lever can be held at the full locking position with movements restricted.

Details of Embodiment of Present Disclosure

Hereinafter, a specific example of the connector of the present disclosure is described with reference to the drawings. Note that the present invention is not limited to these illustrations and is intended to be represented by claims and include all changes in the scope of claims and in the meaning and scope of equivalents.

Embodiment

Figure 3:
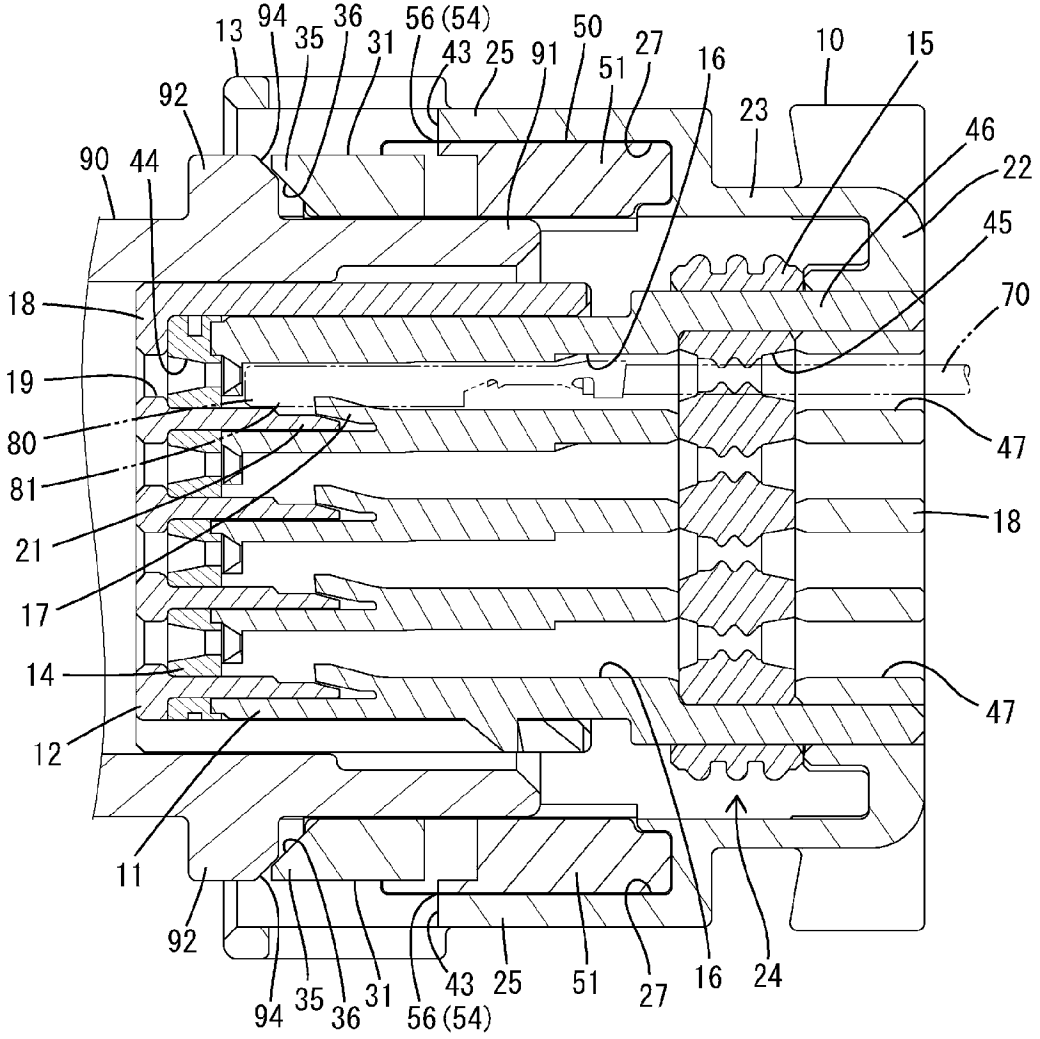
FIG. 3 is a side view in section showing a state where the housing starts being connected to a mating housing in the state of FIG. 2.

A connector of one embodiment includes, as shown in FIG. 3, a housing 10, a lever 50 and terminal fittings 80. The housing 10 is composed of a housing body 11, a front member 12 and a frame 13. A front seal 14 is arranged between the front member 12 and the housing body 11. A rear seal 15 is arranged between the frame 13 and the housing body 11. The lever 50 is movably assembled with the frame 13. The terminal fittings 80 are accommodated into the housing body 11. The housing 10 is connectable to a mating housing 90. Note that, in the following description, surface sides facing each other at the start of connection of the both housings 10, 90 are referred to as front sides concerning a front-rear direction. A vertical direction is based on a vertical direction of each figure except FIGS. 4, 6 and 8.

<Mating Housing>

Figure 7:
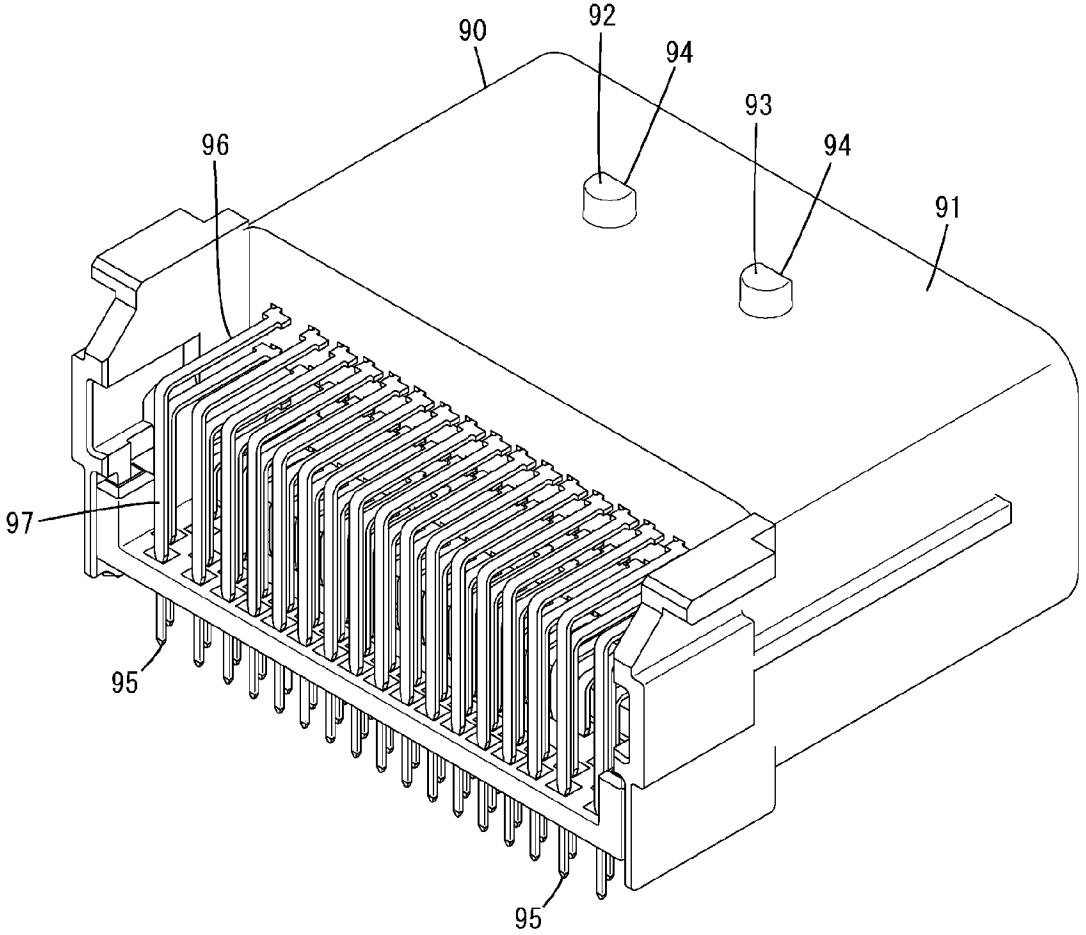
FIG. 7 is a perspective view of the mating housing mounted with mating terminal fittings viewed obliquely from an upper-rear side.

The mating housing 90 is made of synthetic resin and disposed on an unillustrated circuit board. As shown in FIG. 7, the mating housing 90 includes a receptacle 91 in the form of a laterally long rectangular tube. A pair of a first cam follower 92 and a second cam follower 93 are provided on the outer surface of each of upper and lower walls of the receptacle 91. The first and second cam followers 92, 93 have the same shape and are provided side by side on the same axis in a lateral direction (width direction) in the receptacle 91. As shown in FIG. 3, each of the first and second cam followers 92, 93 includes a slope portion 94 inclined forward on a tip part of a cylindrical body part. As shown in FIG. 7, mating terminal fittings 95 are mounted in the mating housing 90.

<Mating Terminal Fittings>

The mating terminal fitting 95 is a male terminal fitting made of conductive metal and includes a horizontal portion 96 extending in the front-rear direction through a back wall of the receptacle 91 and a vertical portion 97 extending downward from the rear end of the horizontal portion 96 as shown in FIG. 7. A lower end side of the vertical portion 97 is inserted into a through hole of the circuit board and electrically connected to a conductive portion of the circuit board.

<Housing>

A body part of the housing 10 is constituted by the housing body 11. The housing body 11 is in the form of a laterally long rectangular block and includes, as shown in FIG. 3, a plurality of cavities 16. The terminal fitting 80 is inserted into the cavity 16 from behind. A locking lance 17 for retaining the terminal fitting 80 is provided to project on an inner wall of the cavity 16.

As shown in FIG. 3, the front member 12 includes a front wall portion 18 along the vertical direction. The front wall portion 18 faces the front seal 14 and restricts the forward escape of the front seal 14. The front wall portion 18 includes a plurality of terminal insertion holes 19 (see FIGS. 1 and 2 and the like). The horizontal portion 96 of the mating terminal fitting 95 is inserted into each terminal insertion hole 19 of the front wall portion 18 from front when the both housings 10, 90 are connected. The front wall portion 18 is provided with restricting pieces 21 projecting rearward to restrict the deflection of the locking lances 17. The front member 12 is held on the housing body 11 via an unillustrated front lock portion.

As shown in FIG. 3, the frame 13 includes a rear wall portion 22 along the vertical direction. The rear wall portion 22 faces the rear seal 15 and restricts the rearward escape of the rear seal 15. The rear wall portion 22 includes a plurality of through holes 47. Wires 70 to be described later are inserted into the through holes 47 of the rear wall portion 22. The frame 13 is held on the housing body 11 via a frame lock portion 46.

The frame 13 includes a tubular peripheral wall portion 23 projecting forward from the outer periphery of the rear wall portion 22. The peripheral wall portion 23 is shaped to surround the outer peripheries of the housing body 11 and the front member 12 (see FIG. 1 and the like). A space forward of the rear wall portion 22 between the housing body 11 (front member 12) and the peripheral wall portion 23 serves as a fitting space 24 into which the receptacle 91 of the mating housing 90 is inserted.

Figure 2:
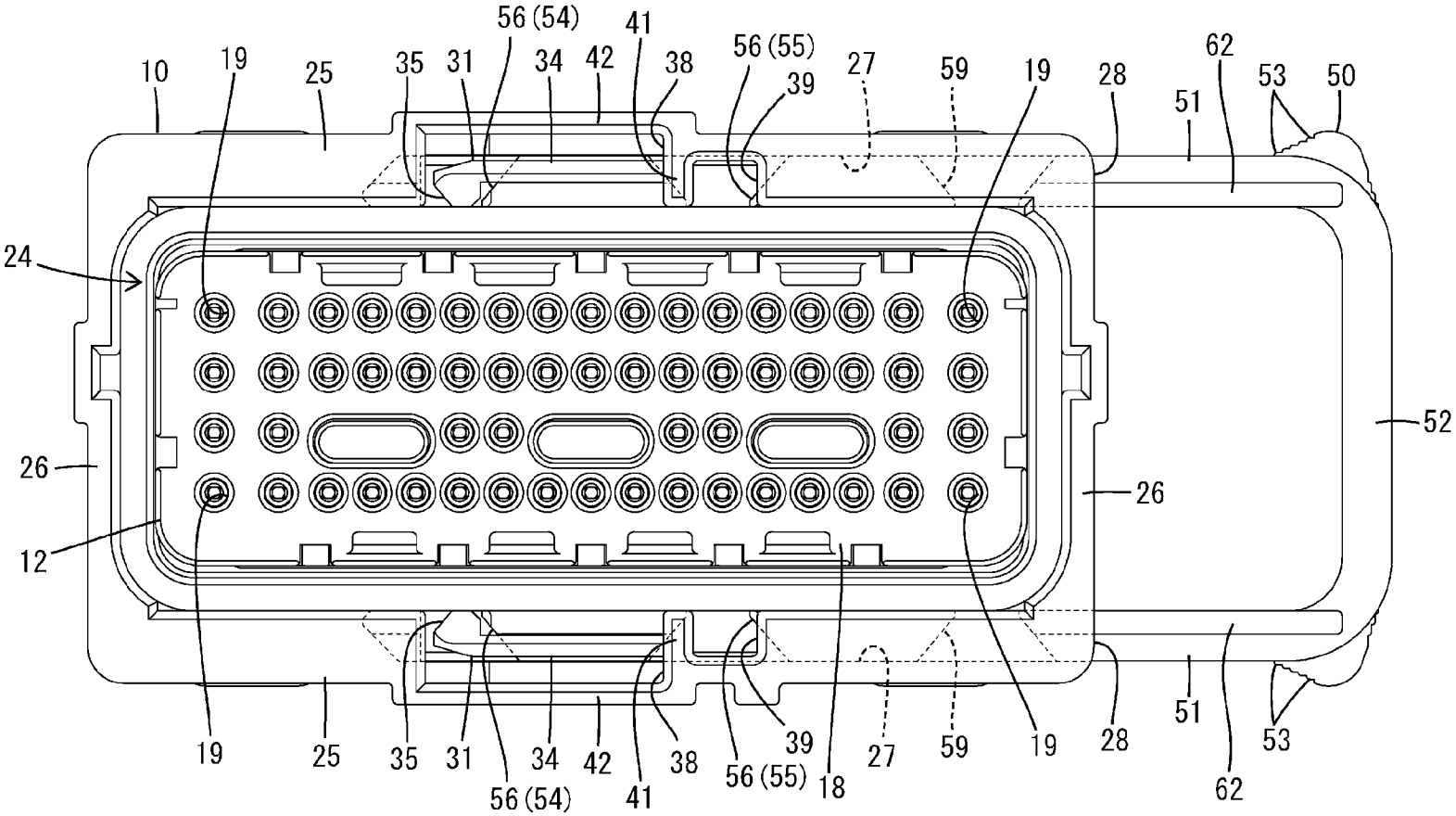
FIG. 2 is a front view showing a state where arm portions are inserted in insertion holes and a lever is held at a partial locking position with respect to a housing.

As shown in FIGS. 1 and 2, the peripheral wall portion 23 includes upper and lower wall portions 25 and left and right side walls 26. The upper and lower wall portions 25 are arranged along the lateral direction (width direction). The left and right side walls 26 are arranged along the vertical direction. Lateral lengths of the wall portions 25 are longer than vertical lengths of the side walls 26.

Figure 8:
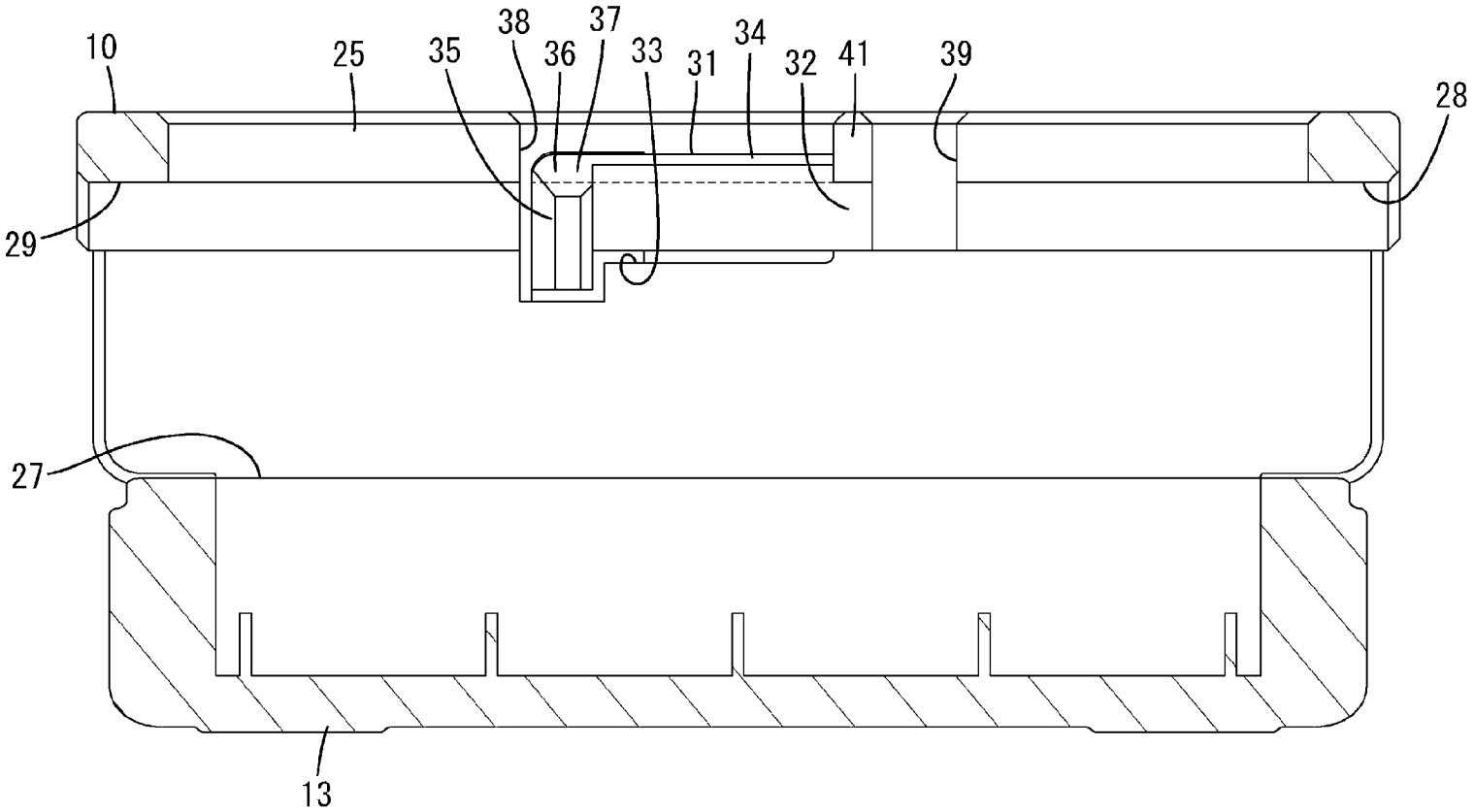
FIG. 8 is a plan view in section of a housing body.

The wall portion 25 is provided with an insertion path 27 extending in the lateral direction. As shown in FIG. 8, the insertion path 27 is formed into a groove open in the inner surface of the wall portion 25. A later-described arm portion 51 of the lever 50 is movably inserted into the insertion path 27. One end (right end) of the insertion path 27 communicates with an insertion hole 28 open in a side surface on one side (right side of FIG. 8) of the peripheral wall portion 23. The other end (left end) of the insertion path 27 communicates with another insertion hole 29 open in a side surface on the other side (left side of FIG. 8) of the peripheral wall portion 23. The insertion hole 28 and the other insertion hole 29 are both in the form of slits elongated in the front-rear direction and open in the side surfaces on the one and the other sides of the peripheral wall portion 23.

A pair of lock pieces 31 are provided on front end parts of the upper and lower wall portions 25 (see FIG. 2 and the like). As shown in FIG. 8, the lock piece 31 is cantilevered in the lateral direction toward the other side (side of the other insertion hole 29) from the one side (side of the insertion hole 28), and deflectable and deformable (resiliently displaceable) inward and outward (upward and downward) with a base end portion 32 on the one side as a fulcrum. The base end portion 32 is arranged behind a later-described partition wall 41. The lock piece 31 is defined and formed in a cutout portion 33 formed in the wall portion 25. The front surface of the lock piece 31 is exposed forward via a front part (first introduction hole 38 to be described later) of the cutout portion 33.

As shown in FIG. 8, the lock piece 31 includes a lock body 34 having the base end portion 32 and extending from the one side toward the other side, and a lock portion 35 connected to the tip (other end) of the lock body 34. The lock body 34 has a constant front-rear width in the lateral direction. The lock portion 35 includes a part connected to the lock body 34 over the entire front-rear width of the lock body 34 and further projecting rearward than the lock body 34. That is, a front-rear width of the lock portion 35 is larger than that of the lock body 34. The lock portion 35 includes a claw-like part projecting inward (toward a vertically central part of the housing 10) (see FIG. 2 and the like). The lock portion 35 has regions inclined inwardly on left and right surfaces of the inwardly projecting part. As shown in FIG. 3, an inclined portion 36 inclined inwardly is provided on the front surface of the lock portion 35.

As shown in FIG. 8, a part (part above a chain line of FIG. 8) of the lock piece 31 on a front end side including the inclined portion 36 of the lock portion 35 serves as a protruding portion 37 located forward of the insertion path 27 over an entire length.

The first introduction hole 38 and a second introduction hole 39 are provided laterally side by side in the wall portion 25. Both the first and second introduction holes 38, 39 are open in the inner and front surfaces of the front end part of the wall portion 25 and the rear ends thereof communicate with the insertion path 27. The first and second cam followers 92, 93 are introduced into the first and second introduction holes 38, 39.

The second introduction hole 39 has a rectangular opening shape corresponding to cross-sectional shapes of the first and second cam followers 92, 93. The first introduction hole 38 includes the cutout portion 33 and the front surface of the lock piece 31 is located inside. Vertical and lateral opening widths of the first introduction hole 38 are larger than those of the second introduction hole 39.

As shown in FIG. 2, the front end part of the wall portion 25 is provided with the partition wall 41 partitioning between the first and second introduction holes 38, 39. The front end part of the wall portion 25 is also provided with a covering wall 42 defining the outer surface (upper or lower surface) of the first introduction hole 38. As shown in FIG. 1, the covering wall 42 is in the form of a flat plate along the front-rear and lateral directions, and arranged outwardly of a surrounding surface of the wall portion 25. The covering wall 42 is arranged to cover a part of the lock body 34 near the base end portion 32 from outside. A window portion 43 is provided to be open in a rear part on one side of the covering wall 42. The lock portion 35 is exposed to outside through the window portion 43.

<Terminal Fittings>

The terminal fitting 80 is a female terminal fitting made of conductive metal and includes, as shown in FIG. 3, a tubular connecting portion 81 on a front side. The horizontal portion 96 of the mating terminal fitting 95 is inserted and connected to the connecting portion 81 when the both housings 10, 90 are connected. A rear side of the terminal fitting 80 is connected to the wire 70 by crimping.

<Front Seal, Rear Seal>

The front seal 14 is made of rubber and in the form of a mat and, as shown in FIG. 3, arranged and sandwiched between the front wall portion 18 of the front member 12 and the housing body 11. The front seal 14 is held in close contact with the front surface of the housing body 11 and includes front seal holes 44 communicating with the respective cavities 16. The horizontal portions 96 of the mating terminal fittings 95 are inserted and sealed in the front seal holes 44.

The rear seal 15 is likewise made of rubber, in the form of a mat one size larger than the front seal 14, and arranged and sandwiched between the rear wall portion 22 of the frame 13 and the housing body 11. The rear seal 15 is held in close contact with the rear surface of the housing body 11 and includes rear seal holes 45 communicating with the respective cavities 16. The wires 70 connected to the terminal fittings 80 are inserted and sealed in the rear seal holes 45.

<Lever>

The lever 50 is made of synthetic resin and, as shown in FIG. 1, is gate-shaped and includes a pair of upper and lower arm portions 51 and a coupling portion 52 coupling the respective arm portions.

The respective arm portions 51 are in the form of laterally long flat plates along the front-rear and lateral directions and arranged in parallel to each other. The coupling portion 52 is connected to end parts of the respective arm portions 51 on one side (right side of FIG. 1) and is arranged along the vertical direction. The coupling portion 52 includes a part projecting further rearward than the respective arm portions 51. A front-rear dimension of the coupling portion 52 is larger than those of the arm portions 51. The rearward projecting part of the coupling portion 52 is formed with a plurality of stripe grooves 53. The coupling portion 52 serves as a hand-grippable part in moving the lever 50. In this case, the plurality of stripe grooves 53 can prevent the slipping of the hand or fingers.

Figure 4:
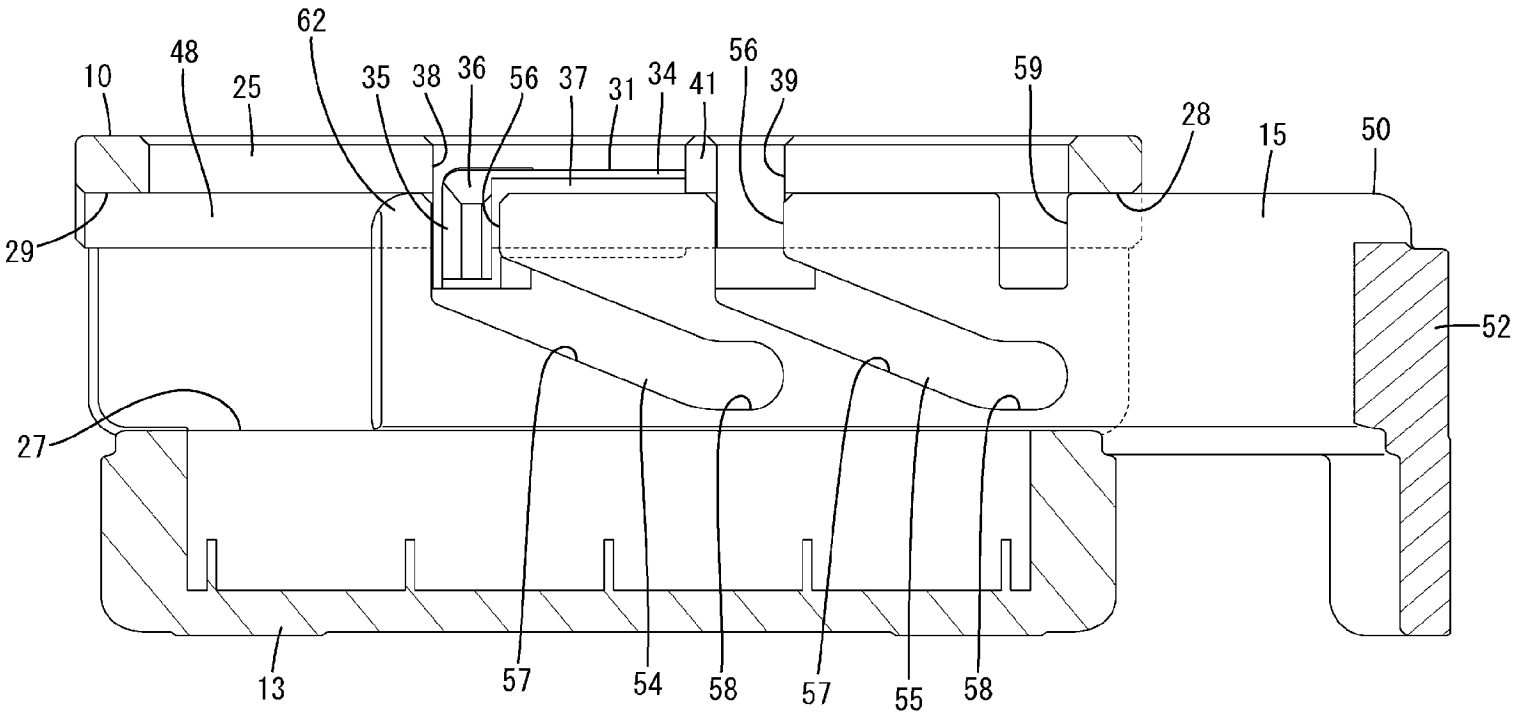
FIG. 4 is a plan view in section in the state of FIG. 2.

As shown in FIG. 4, first cam grooves 54 and second cam grooves 55 are provided side by side in the lateral direction in the inner surfaces (mutually facing surfaces) of the respective arm portions 51. The first cam groove 54 is located on the other side (left side of FIG. 4) with respect to the second cam groove 55, and the second cam groove 55 is located on one side (right side of FIG. 4) with respect to the first cam groove 54.

The first and second cam grooves 54, 55 have the same shape and are arranged in parallel to each other. The first and second cam grooves 54, 55 are formed by recessing the inner surfaces (mutually facing surfaces) of the arm portions 51. Specifically, each of the first and second cam grooves 54, 55 includes an entrance 56 open in the front end of the arm portion 51, a cam body 57 extending obliquely rearward toward one side from the entrance 56, and a back end portion 58 bent from the rear end of the cam body 57 and arranged toward the one side. The entrance 56 of the first cam groove 54 is arranged on a tip side (free end side) of the arm portion 51. The entrance 57 of the second cam groove 55 is arranged on the other side near a lateral center of the arm portion 51.

The entrance 56 of each of the first and second cam grooves 54, 55 is also open in the outer surface of the arm portion 51 in addition to the front end and the inner surface of the arm portion 51 as shown in FIGS. 1 and 2. The entrance 56 of each of the first and second cam grooves 54, 55 is widened toward an outer surface side of the arm portion 51. Both left and right surfaces (inner side surfaces) of the entrance 56 of the second cam groove 55 are inclined outwardly. Out of left and right surfaces of the entrance 56 of the first cam groove 54, one side surface (right side surface of FIG. 2) is inclined outwardly and the other side surface (left side surface of FIG. 2) is arranged along the vertical direction. Further, as shown in FIG. 1, the outer surface on the tip side of the arm portion 51 is chamfered.

Further, as shown in FIGS. 1 and 2, each arm portion 51 includes a recess 59 side by side with the respective entrances 56 of the first and second cam grooves 54, 55. The recess 59 is located on a side opposite to the first cam groove 54 across the second cam groove 55, and arranged on the one side near the lateral center of the arm portion 51. A lateral distance between the first and second cam grooves 54, 55 is equal to that between the second cam groove 55 and the recess 59. The recess 59 is shaped similarly to the second cam groove 55, is open in the front end, the inner surface and the outer surface of the arm portion 51 and has left and right surfaces (inner surfaces) widened outwardly.

As shown in FIG. 1, each arm portion 51 includes an arm body portion 61 connected to the coupling portion 52 while having the same front-rear width as the coupling portion 52, and an extended portion 62 projecting forward from the front end of the arm body portion 61. A plate thickness (vertical thickness) of the extended portion 62 is smaller than that of the arm body portion 61. A step 63 is formed between the arm body portion 61 and the extended portion 62 on the outer surface of each arm portion 51.

The respective entrances 56 of the first and second cam grooves 54, 55 and the recess 59 are provided from the arm body portion 61 to the extended portion 62 and open in the front end of the extended portion 62. The extended portion 62 is inserted into an extended portion insertion path 48 provided on a front end side of the insertion path 27 as shown in FIG. 4. An opening dimension (vertical dimension) of the extended portion insertion path 48 is smaller than that of a rear part of the insertion path 27.

<Assembly Structure and Connection Structure of Connector>

The lever 50 is assembled with the housing 10 movably between a partial locking position and a full locking position. In assembling, the upper and lower arm portions 51 are inserted into the insertion holes 28 of the housing 10 from one side (right side of FIG. 1). The arm portions 51 enter the insertion paths 27 from the insertion holes 28 and are slid toward the other side (left side of FIG. 1) along the insertion path 27. In an assembly process, free end surfaces of the arm portions 51 slide along one side surfaces of the projecting parts of the lock portions 35 and the lock pieces 31 are deflected and deformed outwardly (toward the window portions 43) with the base end portions 32 as fulcrums. When the lever 50 is further moved, the lock pieces 31 resiliently return and, as shown in FIGS. 2 and 4, the projecting parts of the lock portions 35 are fit into the entrances 56 of the first cam grooves 54. In this way, the left and right surfaces of the projecting parts of the lock portions 35 are arranged to face the left and right surfaces of the entrances 56 of the first cam grooves 54.

The contact of the tips (left ends of FIG. 2) of the lock portions 35 with the other side surfaces (left side surfaces of FIG. 2) of the entrances 56 of the first cam grooves 54 restricts the lever 50 from moving toward the one side and escaping from the insertion holes 28. Here, the tips of the lock portions 35 can contact the other side surfaces of the entrances 56 of the first cam grooves 54 along the vertical direction orthogonal to a moving direction of the lever 50. Thus, a movement of the lever 50 toward the one side can be reliably suppressed.

Further, the contact of the other side surfaces of the projecting parts of the lock portions 35 with one side surfaces of the entrances 56 of the first cam grooves 54 restricts a movement of the lever 50 toward the other side. In this way, the lever 50 is held at the partial locking position with lateral movements restricted. At the partial locking position, the entrances 56 of the first cam grooves 54 communicate with the first introduction holes 38 and the entrances 56 of the second cam grooves 55 communicate with the second introduction holes 39. As shown in FIG. 4, the protruding portions 37 of the lock pieces 31 are located forward of the front edges of the arm portions 51 and arranged to be exposed on the front surface of the housing 10 through the first introduction holes 38. Further, at the partial locking position, the coupling portion 52 is arranged away from one side surface of the frame 13 of the housing 10.

Subsequently, the connector is connected to the mating housing 90. At the start of connection, the receptacle 91 of the mating housing 90 is inserted into the fitting space 24, the first cam followers 92 enter the entrances 56 of the first cam grooves 54 through the first introduction holes 38 and the second cam followers 93 enter the entrances 56 of the second cam grooves 55 through the second introduction holes 39. The first cam followers 92 interfere with the lock portions 35 by entering the entrances 56 of the first cam grooves 54 (see FIG. 3). Here, the slope portions 94 of the first cam followers 92 slide along the inclined portions 36 of the lock portions 35, whereby the lock pieces 31 are deflected and deformed outwardly with the base end portions 32 as fulcrums. As the lock pieces 31 are deflected and deformed outwardly, the projecting parts of the lock portions 35 are displaced in directions to escape from the entrances 56 of the first cam grooves 54 and the lever 50 becomes movable from the partial locking position to the full locking position.

Figure 5:
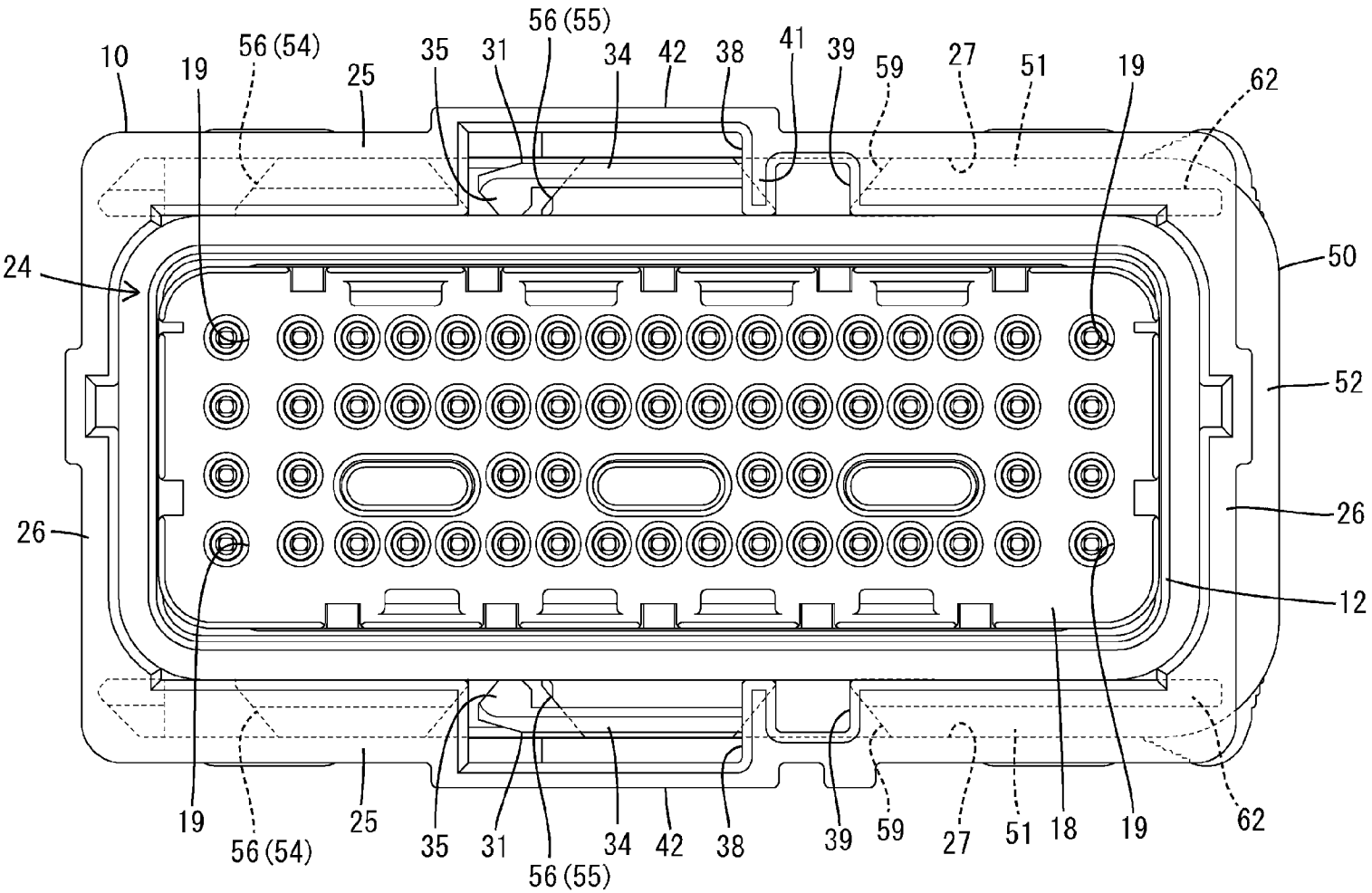
FIG. 5 is a front view showing a state where a coupling portion is pushed from the state of FIG. 2 and the lever is held at a full locking position with respect to the housing.
Figure 6:
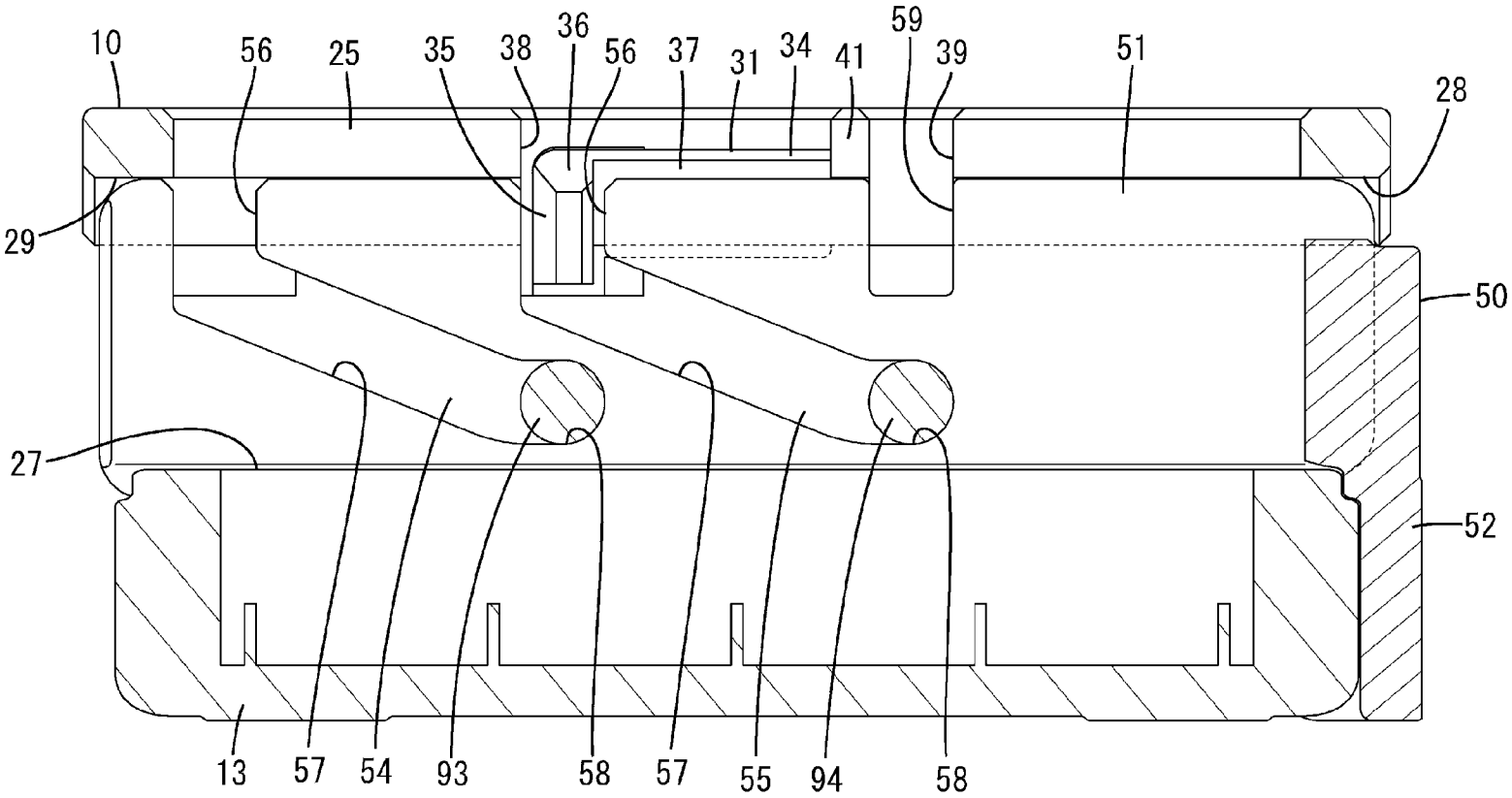
FIG. 6 is a plan view in section showing a state where a first cam follower and a second cam follower are arranged in back end portions in the state of FIG. 5.

Subsequently, the coupling portion 52 is pushed toward the other side (left side of FIGS. 2 and 4) and the lever 50 moves toward the full locking position. When the arm portions 51 are deeply inserted into the insertion paths 27, the lock portions 35 ride on the outer surfaces of the arm portions 51 with the lock pieces 31 deflected and deformed. When the lever 50 reaches the full locking position, the lock pieces 31 resiliently return and, as shown in FIGS. 5 and 6, the projecting parts of the lock portions 35 are fit into the entrances 56 of the second cam grooves 55. The left and right surfaces of the projecting parts of the lock portions 35 are arranged to face the left and right surfaces of the entrances 56 of the second cam grooves 55, whereby the lever 50 is held at the full locking position with movements restricted. Further, at the full locking position, the coupling portion 52 is arranged to contact the one side surface of the frame 13 of the housing 10.

In the process of moving the lever 50 to the full locking position, the first cam followers 92 slide on the groove surfaces of the cam bodies 57 of the first cam grooves 54 and the second cam followers 93 slide on the groove surfaces of the cam bodies 57 of the second cam grooves 55. In this way, a cam action is achieved between the lever 50 and the mating housing 90 and a connecting operation of the both housings 10, 90 proceeds. When the lever 50 reaches the full locking position, the first and second cam followers 92, 93 enter the back end portions 58 of the first and second cam grooves 54, 55 as shown in FIG. 6. When the lever 50 is at the full locking position, the terminal fittings 80 are electrically connected to the mating terminal fittings 95. Further, in the process of moving the lever 50 to the full locking position and when the lever 50 is at the full locking position, the protruding portions 37 of the lock pieces 31 are maintained in such a state where the protruding portions 37 are located forward of the front edges of the arm portions 51 and arranged to be exposed on the front surface of the housing 10 through the first introduction holes 38.

Figure 9:
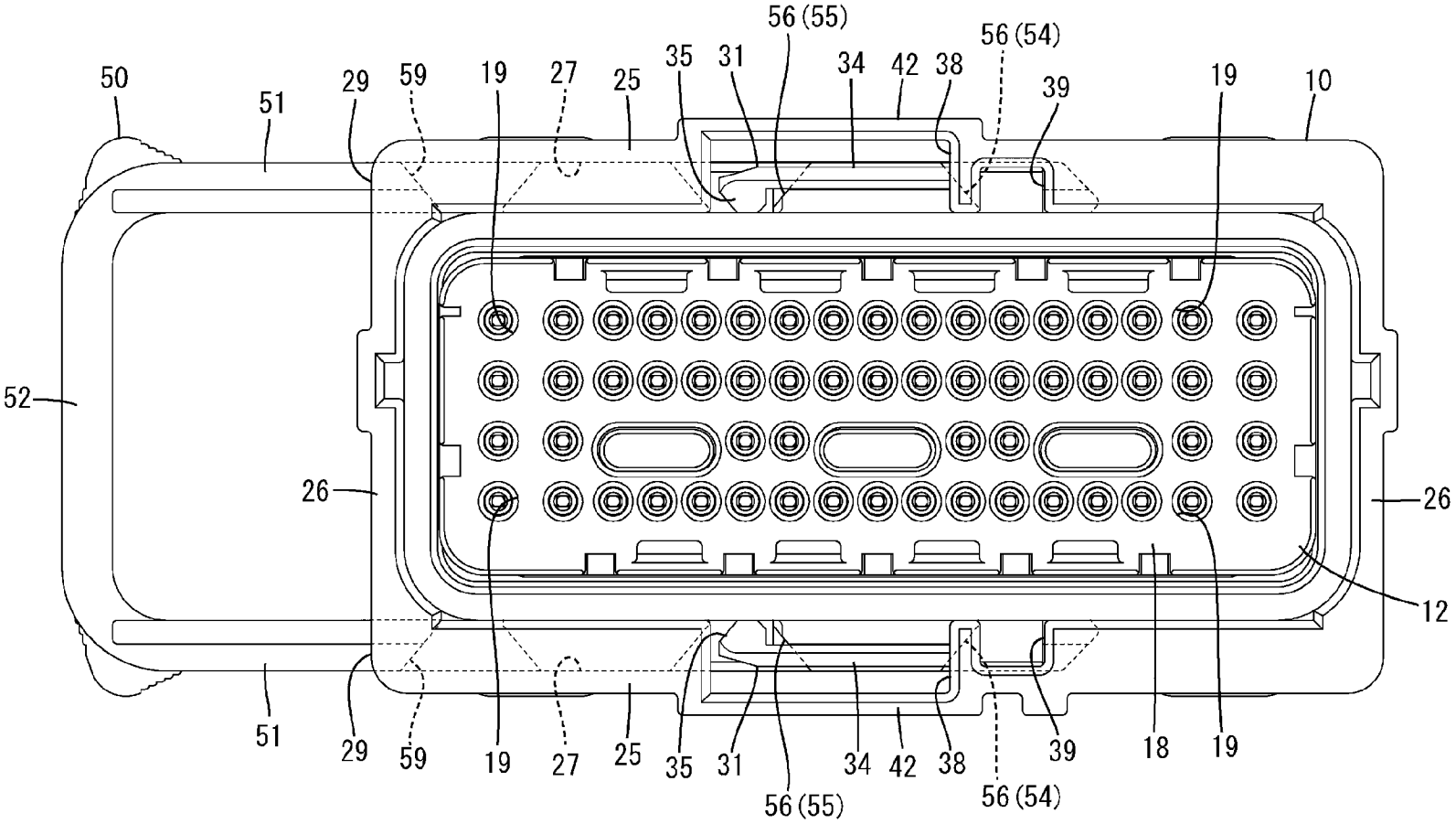
FIG. 9 is a front view showing a state where the arm portions are inserted in other insertion holes and the lever is held at the partial locking position with respect to the housing.

On the other hand, in this embodiment, the lever 50 can also be assembled with the housing 10 from the other side (left side of FIG. 9) depending on an installation situation of the connector. In this case, the upper and lower arm portions 51 are inserted into the other insertion holes 29 of the housing 10 from the other side. When the lever 50 is pushed toward the one side and reaches the partial locking position, the entrances 56 of the first cam grooves 54 communicate with the second introduction holes 39, the entrances 56 of the second cam grooves 55 communicate with the first introduction holes 38, and the projecting parts of the lock portions 35 are fit into the entrances 56 of the second cam grooves 55 as shown in FIG. 9. In this way, the left and right surfaces of the projecting parts of the lock portions 35 are arranged to face the left and right surfaces of the entrances 56 of the second cam grooves 55 and the lever 50 is held in the housing 10 with movements restricted.

Figure 10:
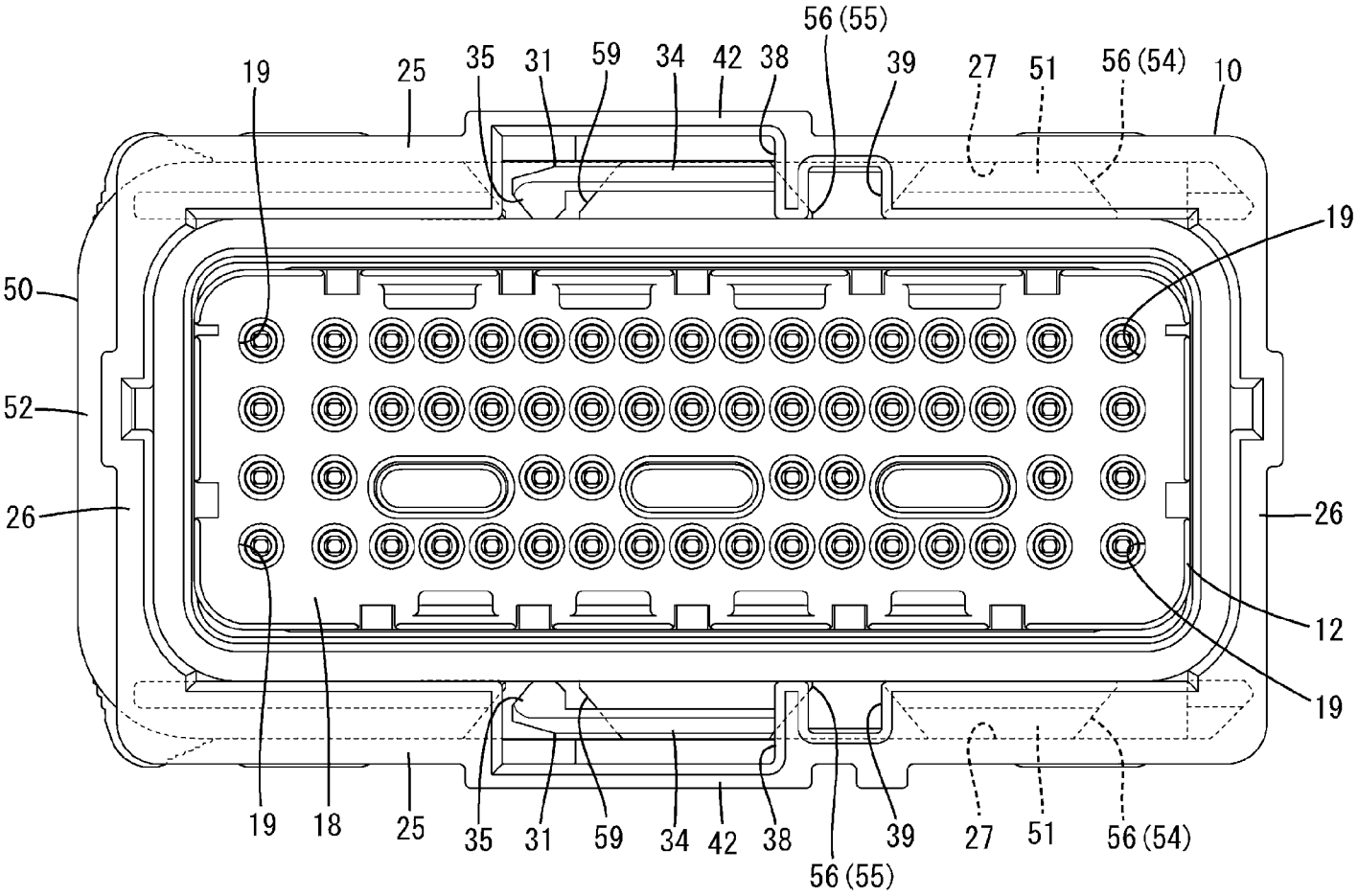
FIG. 10 is a front view showing a state where the coupling portion is pushed from the state of FIG. 9 and the lever is held at the full locking position with respect to the housing.

At the start of connection of the both housings 10, 90, the first cam followers 92 enter the entrances 56 of the second cam grooves 55 to interfere with the lock portions 35, and the lock pieces 31 are deflected and deformed outwardly. In this way, the lever 50 becomes movable to the full locking position as in the above case. When the lever 50 reaches the full locking position and a deflected state of the lock pieces 31 is released, the projecting parts of the lock portions 35 are fit into the recesses 59 as shown in FIG. 10. In this way, the left and right surfaces of the projecting parts of the lock portions 35 are arranged to face the left and right surfaces of the recesses 59 and the lever 50 is held in the housing 10 with movements restricted.

As described above, according to this embodiment, the lock portions 35 can enter the entrances 56 of the first cam grooves 54 or the entrances 56 of the second cam grooves 55 and contact the left and right surfaces (inner side surfaces) of the entrances 56 when the lever 50 is at the partial locking position. Thus, the lever 50 is held in the housing 10 with movements restricted. The first cam followers 92 interfere with the lock portions 35 and the lock pieces 31 are resiliently displaced outwardly (toward a side to intersect the moving direction of the lever 50 to the full locking position), whereby the partially locked state of the lever 50 can be released. Here, the lock portions 35 include the protruding portions 37 projecting from the entrances 56. Thus, in determining the size and the shape of the lock portions 35, the groove widths and the like of the first and second cam grooves 54, 55 can be made less influential and a degree of freedom in design can be enhanced. As a result, the lock portions 35 can be made to stably contact the left and right surfaces of the entrances 56 and reliability in holding the lever 50 at the partial locking position can be improved.

Further, since the lock portions 35 can contact the groove surfaces of the second cam grooves 55 when the lever 50 is inserted into the insertion holes 28 and located at the full locking position, the lever 50 can be held at the full locking position with movements restricted. Since the first and second cam grooves 54, 55 have both a function of connecting the both housings 10, 90 and a function of restricting movements of the lever 50, the structure of the connector can be simplified as compared to the case where the both functions are separately provided.

Furthermore, according to this embodiment, the lever 50 can be selectively inserted into either the insertion holes 28 or the other insertion holes 29 according to the installation situation of the connector. Particularly, also when the lever 50 is inserted into the other insertion holes 29 and located at the full locking position, the lever 50 can be held at the full locking position with movements restricted by the contact of the lock portions 35 with the left and right surfaces of the recesses 59.

OTHER EMBODIMENTS OF PRESENT DISCLOSURE

The embodiment disclosed this time should be considered illustrative in all aspects, rather than restrictive.

Although the protruding portion is provided over the entire length on the front end side of the lock piece in the case of this embodiment, a protruding portion may be provided only on a front end side of a lock portion as another embodiment.

Although the cam body and the back end portion of the cam groove are provided to be open only in the inner surface of the arm portion in the case of this embodiment, a cam body and a back end portion of a cam groove may be provided to penetrate through inner and outer surfaces of an arm portion.

Although the arm portion is provided with the first and second cam grooves as cam grooves in the case of this embodiment, an arm portion may be provided with only one cam groove as another embodiment.

Although the lever is configured to slide with respect to the housing in the case of this embodiment, a lever may be configured to move rotationally about a support shaft with respect to a housing as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing connectable to a mating housing; and a lever arranged movably from a partial locking position before connection of the housing and the mating housing to a full locking position after the connection with respect to the housing, wherein:

the lever includes a cam groove, the mating housing includes a cam follower capable of contacting a groove surface of the cam groove, an entrance of the cam groove is open in an edge part of the lever, the housing includes a lock piece resiliently displaceable in a direction intersecting a moving direction of the lever to the full locking position, the lock piece includes a lock portion arranged at the entrance of the cam groove and facing an inner surface of the entrance of the cam groove with the lever located at the partial locking position, the lock portion includes a protruding portion projecting from the entrance of the cam groove, an insertion hole is provided to be open in one side surface of the housing, another insertion hole is provided to be open in another side surface opposite to the one side surface in the housing, the cam groove includes a first cam groove arranged on a front side in the moving direction and a second cam groove arranged on a rear side in the moving direction, the lever includes a recess side by side with the first and second cam grooves, the recess is open in an edge part of the lever, and the lock portion is arranged at the entrance of the second cam groove to face the inner surface of the entrance of the second cam groove when the lever is arranged in the another insertion hole and located at the partial locking position, and the lock portion is arranged in the recess to face an inner surface of the recess when the lever is arranged in the another insertion hole and located at the full locking position.

2. The connector of claim 1, wherein:

the cam follower includes a first cam follower corresponding to the first cam groove and a second cam follower corresponding to the second cam groove, the lock portion is arranged at an entrance of the first cam groove to face an inner surface of the entrance of the first cam groove with the lever arranged in the insertion hole and located at the partial locking position, and the lock portion is arranged at an entrance of the second cam groove to face an inner surface of the entrance of the second cam groove with the lever arranged in the insertion hole and located at the full locking position.

3. The connector of claim 1, wherein the recess is located on a side opposite to the first cam groove across the second cam groove.

4. The connector of claim 1, wherein a lateral distance between the first and second cam grooves is equal to a lateral distance between the second cam groove and the recess.

5. The connector of claim 1, wherein the recess is shaped similarly to the second cam groove.

* * * * *